US005537747A

United States Patent [19]

Cacciotti et al.

[11] Patent Number: 5,537,747

[45] Date of Patent: Jul. 23, 1996

[54] NAIL CLIPPING APPARATUS

[75] Inventors: Paul V. Cacciotti; Vincent S. Cacciotti, both of Troy, N.Y.

[73] Assignee: Industrial Tool & Die Company, Inc., Troy, N.Y.

[21] Appl. No.: 492,328

[22] Filed: Jun. 19, 1995

[51] Int. Cl.[6] ..... A45D 29/00

[52] U.S. Cl. ..... 30/28; 30/125; 132/75.5

[58] Field of Search ..... 30/26, 28, 125, 30/131; 132/73, 75.5, 75.4

[56] References Cited

U.S. PATENT DOCUMENTS

| | | | |
|---|---|---|---|
| 2,179,435 | 11/1939 | Smith | 30/28 |
| 2,515,852 | 7/1950 | Bilsky | 30/28 |
| 3,744,131 | 7/1973 | Manes | 30/28 |
| 4,574,475 | 3/1986 | Lee | 30/28 |
| 4,614,031 | 9/1986 | Chen | 30/28 |
| 5,072,511 | 12/1991 | Ro | 30/28 |

*Primary Examiner*—Hwei-Siu Payer
*Attorney, Agent, or Firm*—John A. Merecki

[57] ABSTRACT

A nail clipping apparatus incorporating an internal receptacle, formed by an upper movable body section and a lower stationary body section, for capturing and storing nail clippings for subsequent disposal, and a finger actuated lever for displacing a cutting edge formed on the upper movable body section toward a complementary cutting edge formed on the lower body. The nail clipping apparatus further includes a cover which is pivotally secured to the upper movable body section. The cover is utilized to provide access to nail clippings captured within the internal receptacle and to selectively couple the finger actuated lever and the upper movable body section during a nail clipping operation.

5 Claims, 3 Drawing Sheets

NAIL CLIPPING APPARATUS

FIELD OF THE INVENTION

The present invention relates in general to nail clipping systems and, more particularly, to a novel "postless" nail clipping apparatus including an internal receptacle for efficiently capturing and storing nail clippings.

BACKGROUND OF THE INVENTION

A wide variety of nail clipping systems are currently available for the cutting or trimming of finger and/or toe nails. As known in the art, such nail clipping systems generally include a substantially planar lower section having an upwardly directed front cutting edge, a substantially planar upper section having an downwardly directed front cutting edge, and a lever for directing the downwardly directed front cutting edge of the upper section against the upwardly directed front cutting edge of the lower section. A spring biasing action, created by fixedly securing the rear ends of the lower and upper sections together, returns the downwardly directed front cutting edge of the upper section to its original, precutting orientation upon the release of the lever.

Typically, the lower section includes an interior mounting post having a distal end which extends through an aperture in the upper section of the nail clipping system. The mounting post and the aperture are disposed immediately behind the upwardly and downwardly directed front cutting edges of the lower and upper sections, respectively. As known in the art, the mounting post serves simultaneously as the fulcrum of the lever and as a guide for the lever actuated, vertical displacement of the front cutting edge of the upper section.

As a nail is cut by the mutual cutting action of the opposing front cutting edges, the nail clipping passes toward the interior of the nail clipping system between the upper and lower sections thereof. Since the sides of the nail clipping system remain in an open state throughout the nail cutting operation, the nail clipping is not prevented from passing out of the nail clipping system, thereby hindering subsequent disposal of the nail clipping. Further, the nail clipping is generally expelled rapidly toward the interior of the nail clipping system during a nail cutting operation, oftentimes flying several feet away from the user after ricocheting off of the front or sides of the mounting post.

SUMMARY OF THE INVENTION

In order to overcome the deficiencies of prior art nail clipping systems, the present invention provides a "postless" nail clipping apparatus incorporating an internal receptacle for efficiently capturing and storing nail clippings for subsequent disposal.

Generally, the nail clipping apparatus of the present invention includes an internal receptacle for capturing nail clippings, wherein the internal receptacle is formed by an upper movable body section and a lower stationary body section. An anterior end of the lower stationary body section includes a lower jaw member having an upwardly directed nail cutting edge. The anterior end of the upper movable body section includes an upper jaw member having a complementary, downwardly directed nail cutting edge.

A lever, pivotally mounted to a pair of upwardly directed flanges disposed on opposing sides of the lower jaw member, is utilized to displace the downwardly directed cutting edge of the upper jaw member against the upwardly directed cutting edge of the lower jaw member to cut away a section of a nail inserted therebetween. As the nail clipping is separated from the user's nail, the clipping is expelled into and trapped within the internal receptacle.

A cover, pivotally mounted to the upper movable body section, provides access to the nail clippings which have been trapped within the internal receptacle of the nail clipping apparatus. Additionally, the cover, when closed, serves as a means for selectively coupling the lever to the upper movable body section of the nail clipping apparatus. Specifically, when the cover is in a closed position, a protuberance on the underside of the lever engages the top surface of the cover as the lever is depressed, thereby displacing the downwardly directed cutting edge of the upper jaw member against the upwardly directed cutting edge of the lower jaw member. After the cover has been pivoted from a closed position to an open position, the protuberance on the underside of the lever passes into the interior of the nail clipping apparatus as the lever is pivoted toward the upper movable body section, allowing the lever to be folded substantially flat against the upper movable body section. Additionally, with the cover its open position, previously captured nail clippings may be emptied from the internal receptacle of the nail clipping apparatus.

BRIEF DESCRIPTION OF THE DRAWINGS

These and other features and advantages of the present invention will become readily apparent upon reading the following detailed description and upon reference to the drawings in which.

DETAILED DESCRIPTION OF THE INVENTION

Figure 1:
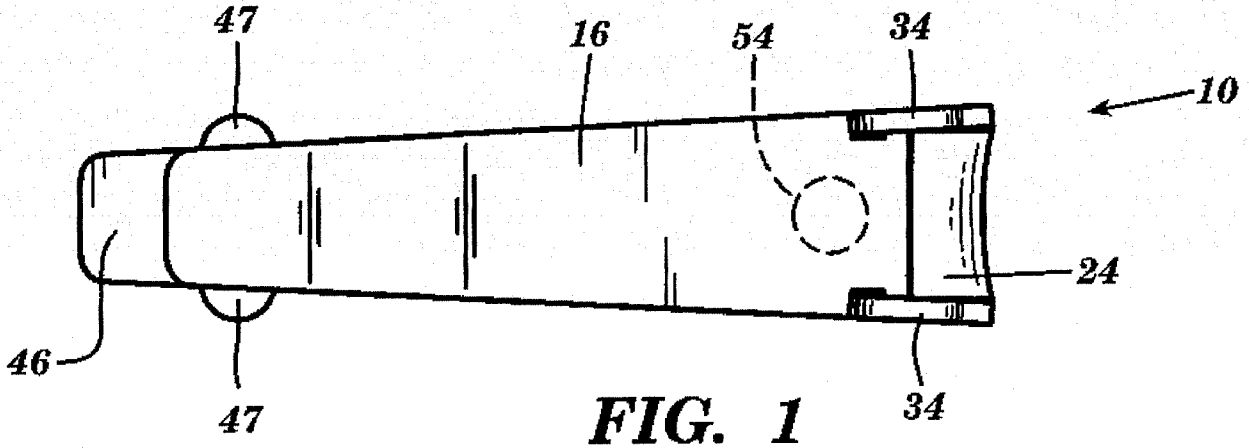
FIG. 1 is a plan view of a nail clipping apparatus in accordance with a first, preferred embodiment of the present invention, wherein the nail clipping apparatus is in a closed configuration.
Figure 3:
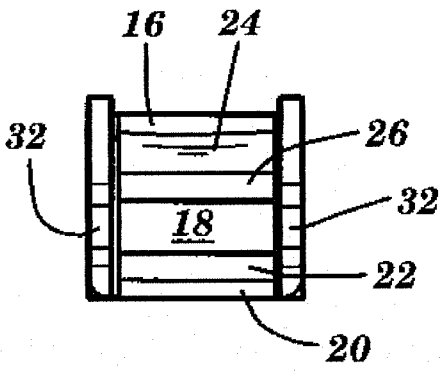
FIG. 3 is a front view of the nail clipping apparatus of FIG. 1, illustrating the complementary nail cutting edges of the upper and lower jaw members.

Referring first specifically to FIGS. 1–7 of the drawings, there is illustrated a nail clipping apparatus, generally designated as 10, in accordance with a first, preferred embodiment of the present invention, wherein like reference numerals refer to like components throughout the drawings.

The nail clipping apparatus 10 of the present invention generally includes a lower stationary body section 12, an upper movable body section 14 and a finger actuated lever 16 for displacing the upper movable body section 14 toward the lower stationary body section 12 during a nail clipping operation. As presented in greater detail hereinbelow, the lower stationary body section 12 and the upper movable body section 14 are configured to provide an internal receptacle 18 for capturing nail clippings (not shown).

The lower stationary body section 12 of the nail clipping apparatus includes a lower jaw member 20 having an upwardly directed nail cutting edge 22. Analogously, the upper movable body section 14 includes a complementary, upper jaw member 24 having a downwardly directed nail cutting edge 26. During a nail clipping operation, the finger actuated lever 16 is utilized to displace the downwardly directed nail cutting edge 26 on the upper jaw member 24 toward the upwardly directed nail cutting edge 22 on the lower jaw member 20. Preferably, each of the nail cutting edges 22, 26, is formed in a concave configuration designed to follow the general arcuate outline of a user's nail.

Figure 5:
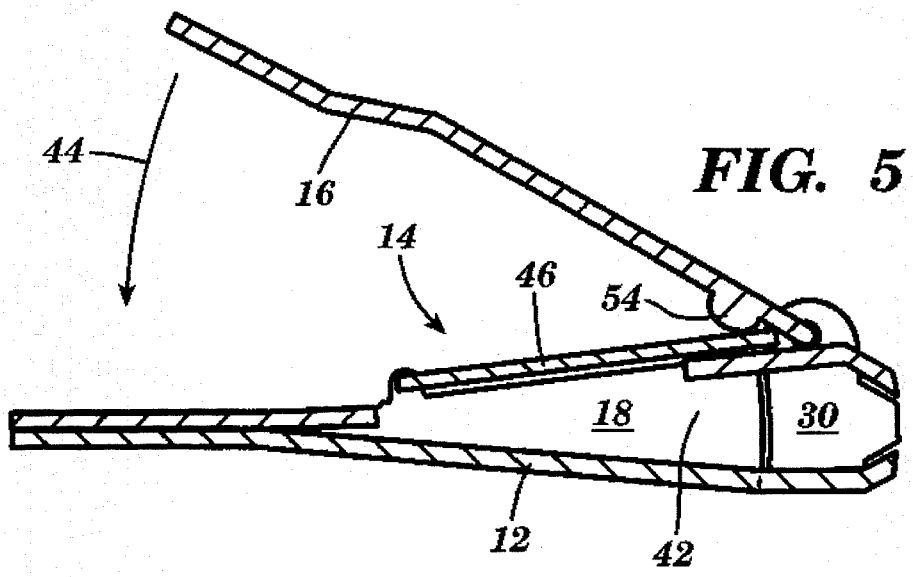
FIGS. 5 and 6 are cross-sectional views illustrating the displacement of the upper movable body section (and downwardly directed cutting edge) toward and around the lower stationary body section (and upwardly directed cutting edge) as the protuberance on the underside of the lever engages the surface of the pivotable cover upon actuation of the lever.

As shown most clearly in FIG. 5, the lower stationary body section 12 extends along the underside of the nail clipping apparatus from a rear end 28 thereof to the lower jaw member 20. The lower stationary body section 12 further includes a pair of flanges 30 located immediately behind the lower jaw member 20. Each flange 30 includes a front extension 32, designed to seal the gap between opposing sides of the lower and upper jaw members 20, 24 immediately behind the nail cutting edges 22, 26, and an upper extension 34 having an aperture 36 for rotatably receiving one of the posts 38 formed integrally on opposing sides of the front end of the finger actuated lever 16. As should be readily apparent, the posts 38 are designed to be rotated within a corresponding aperture 36 as the finger actuated lever 16 is pivoted upward or downward during the operation of the nail clipping apparatus 10.

Figure 4:
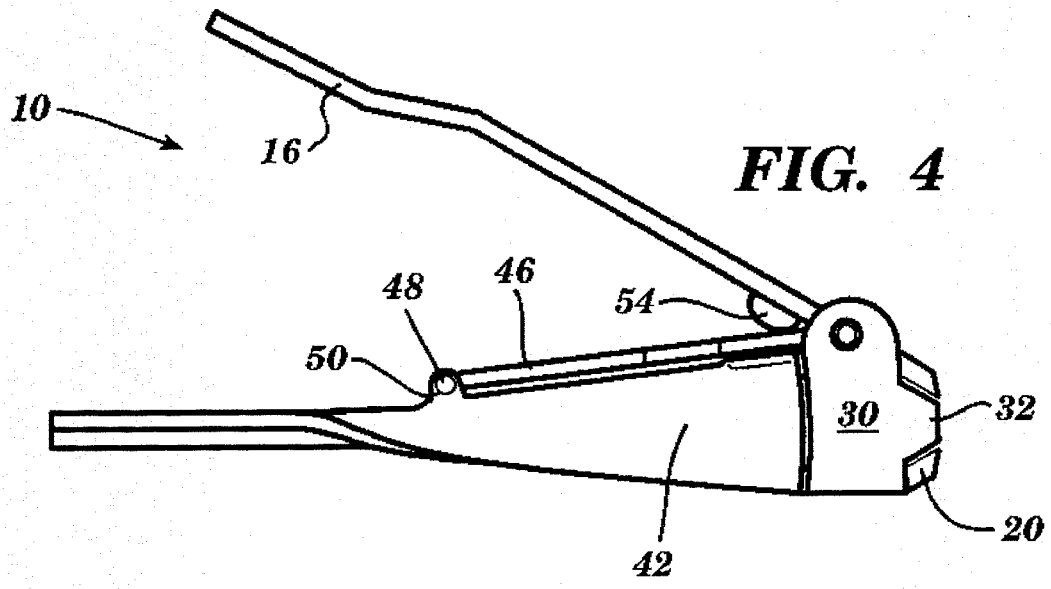
FIG. 4 is a side elevation view of the nail clipping apparatus illustrated in FIG. 1, with the pivotable cover in a closed position and the protuberance on the underside of the lever contacting the upper surface of the cover.

In addition to the upper jaw member 24 and downwardly directed nail cutting edge 26, the upper movable body section 14 includes a rear end 40 which is riveted or otherwise fixedly secured to the rear end 28 of the lower stationary body section 12. As illustrated, the upper movable body section 14 slopes gradually away from the lower stationary body section 12 as one moves away from the fixedly coupled rear end 40 thereof toward the upper jaw 24. By utilizing such a configuration, the upper movable body section 14 is designed to return or "spring back" to its original, precutting state, as illustrated in FIG. 4, upon completion of a nail cutting operation.

The upper movable body section 14 further includes a pair of downwardly extending side members 42 which are designed to enclose opposing sides of the internal receptacle 18 formed by the lower stationary body section 12 and upper movable body section 14. Preferably, as illustrated throughout the drawings, the side members 42 extend laterally just beyond the sides of the lower stationary section 12, thereby allowing the side members 42 to be displaced vertically relative to the lower stationary body section 12.

Figure 6:
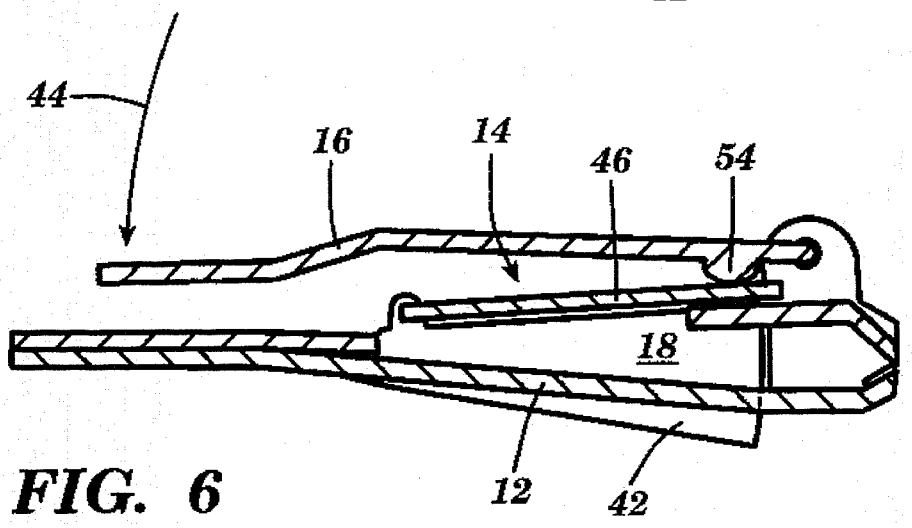

The vertical displacement of the side members 42 is shown in detail in FIGS. 5 and 6. Specifically, as the lever 16 is depressed during a nail clipping operation (as indicated by directional arrow 44) the upper movable body section 14 is displaced toward the lower stationary body section 12, thereby forcing the pair of side members 42 downward about opposing sides of the lower stationary body section 12. By utilizing such a configuration, the nail clippings captured within the internal receptacle 18 are prevented from escaping through the sides of the nail clipping apparatus 10. The pair of flanges 30 also operate to prevent nail clipping from escaping through the sides of the nail clipping apparatus 10 immediately behind the upper and lower jaw members 24, 20.

The nail clipping apparatus 10 of the present invention further includes a cover 46 which is pivotally mounted to the upper movable body section 14. The cover 46 includes a pair of opposing posts 48 which are inserted within a corresponding pair of apertured flanges 50. As depicted most clearly in FIG. 7, the cover 46 may be manually pivoted between a closed position (shown in phantom as 46') and an open position (shown in phantom as 46"). In the closed position 46', the cover 46 seals an opening 52 which provides access to the internal receptacle 18 of the nail clipping apparatus 10, allowing a user to dispose of any nail clippings captured therein. To facilitate the pivoting of the cover between open and closed positions, the cover 46 includes a pair of laterally extending wings 47 which are designed to be easily gripped by a user's fingers.

The cover 46, when closed over the opening 52, serves as a means for selectively coupling the finger actuated lever 16 and the upper movable body section 14 of the nail clipping apparatus 10. Specifically, as shown in FIGS. 5 and 6, a protuberance 54 formed on the underside of the lever 16 engages the top surface of the cover 46 as the lever 16 is depressed by the user toward the upper movable body section (directional arrow 44). In response to the downward actuation of the lever 16, the upper movable body section 14 is forced toward the lower stationary body section 12. When a user's nail is inserted between the cutting edges 22, 26, the portion of the nail located within the nail cutting apparatus 10 is severed by the cutting action of the cutting edges 22, 26 and is subsequently captured within the internal receptacle 18. When the cover 46 is pivoted from a closed position 46' to an open position 46", any nail clippings previously captured within the internal receptacle 18 may be emptied from the nail clipping apparatus 10 through the opening 52.

Figure 7:
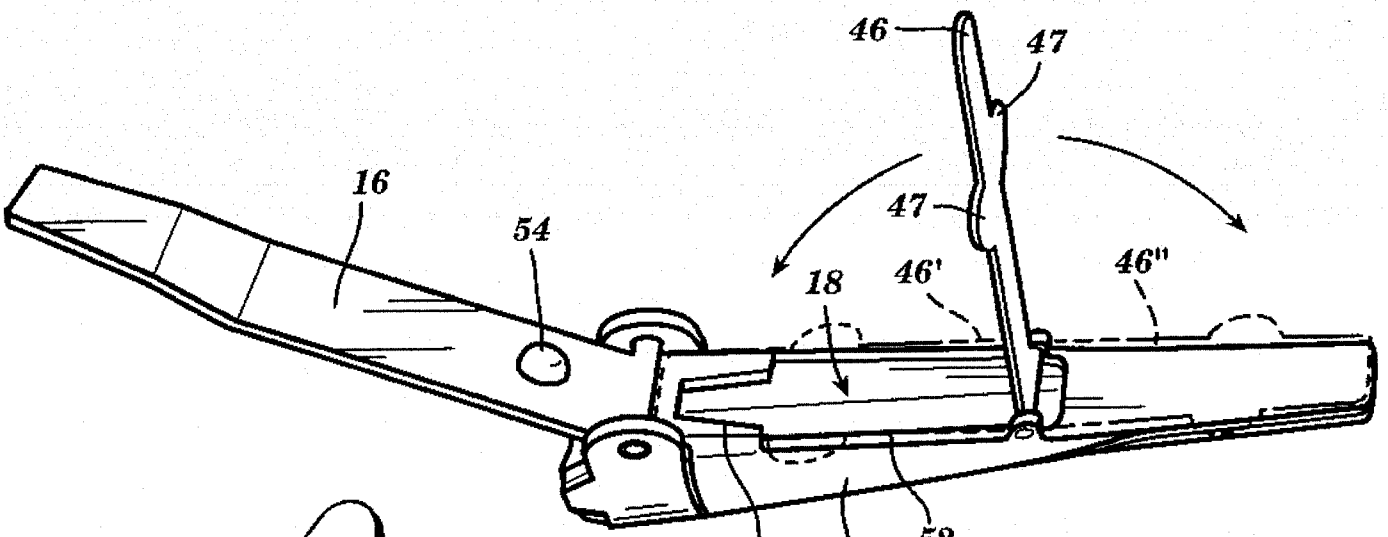
FIG. 7 is a perspective view of a nail clipping apparatus in accordance with the first, preferred embodiment of the present invention, illustrating the pivotable motion of the cover and the internal receptacle formed by the upper movable body section and the lower stationary body section.

As illustrated in FIG. 7, the opening 52 includes an end area 56 which is appropriately sized to accommodate the protuberance 54. Correspondingly, the cover 46 includes a distal end which is adapted to seal the end area 56 of the opening 52 to prevent nail clipping from escaping therethrough from the internal receptacle 18 of the nail clipping apparatus.

Figure 2:
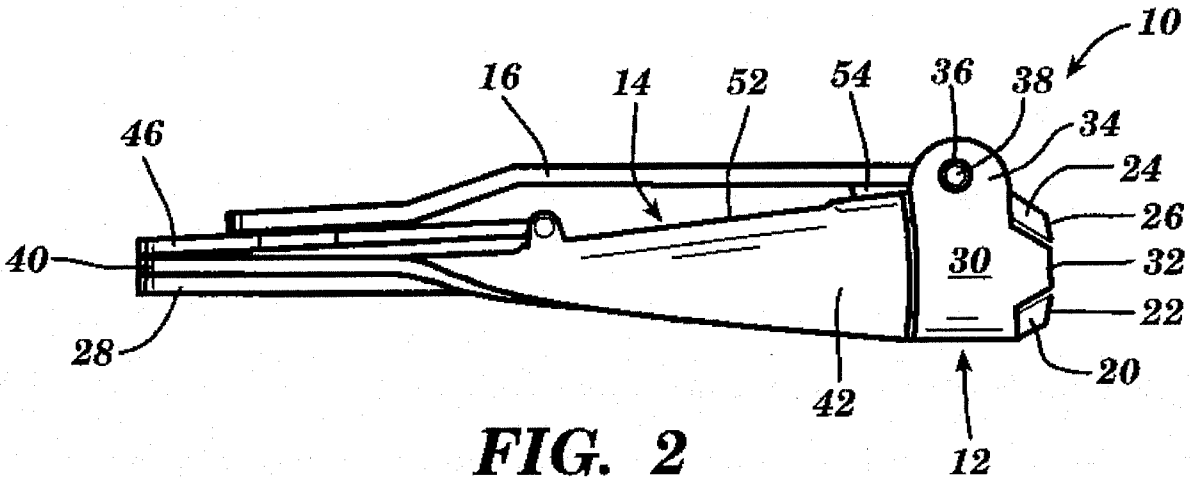
FIG. 2 is a side elevational view of the nail clipping apparatus illustrated in FIG. 1.

When the cover 46 is in the open position 46", the protuberance 54 on the underside of the finger actuated lever 16 is designed to pass into the interior receptacle 18 of the nail clipping apparatus, through the end area 56 of the opening 52, as the lever 16 is folded downward against the upper movable body section 14. As shown in FIG. 2, such a design allows the lever 16 to be folded substantially flat against the upper movable body section, advantageously minimizing the nonoperational dimensions of the nail clipping apparatus 10.

Figure 8:
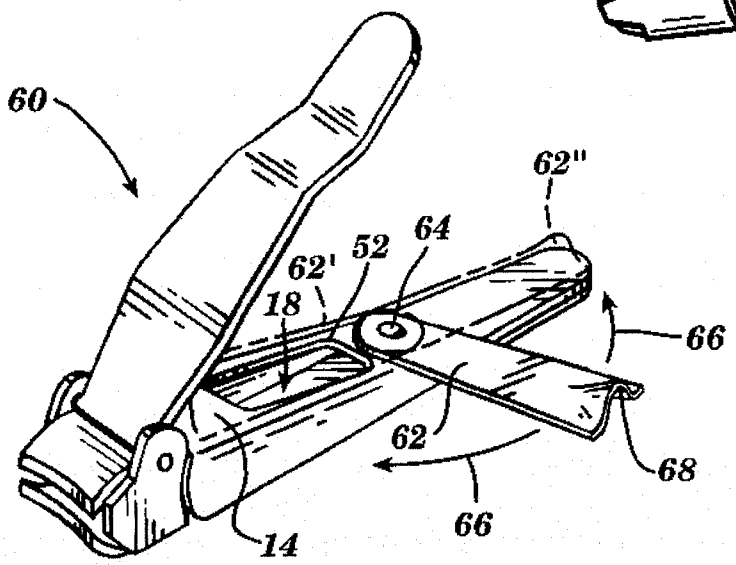
FIG. 8 is a perspective view of a nail clipping apparatus in accordance with a second embodiment of the present invention.

A second embodiment of the nail clipping apparatus, generally designated as 60, is illustrated in FIG. 8. As shown, the nail clipping apparatus 60 is substantially similar to the nail clipping apparatus 10 described above, with the exception of the structure and operation of the cover 62 for sealing the opening 52 to the interior receptacle 18. Unlike the cover 46 utilized in the first, preferred embodiment of the nail clipping apparatus 10, the cover 62 is pivotally secured to a vertical post 64 located on the upper movable body section 14. Accordingly, the cover 62 is constrained to pivot horizontally about the vertical post 64, as depicted by directional arrows 66, between closed and open positions 62' and 62", respectively. Further, a protuberance 68, preferably formed by suitably folding a distal end of the cover 62, is utilized in lieu of the protuberance 54 previously described with regard to the nail clipping apparatus 10 to selectively couple the lever 16 and the upper movable body section 14. Specifically, as the lever 16 is depressed by the user toward the upper movable body section 14, the underside of the lever 16 engages the protuberance 68 on the cover 62, forcing the cutting edges of the opposing jaw members toward each other.

In the closed position 62', the cover 62 serves to seal the opening 52 and selectively couple the lever 16 and the upper movable body section 14 during a nail clipping operation. In the open position, 62", the lever 16 is again prevented from engaging the protuberance 68, thereby allowing the lever 16 to be folded substantially flat against the upper movable body section 14 of the nail clipping apparatus 60.

The foregoing description of the preferred embodiments of the invention has been presented for purposes of illustration and description. It is not intended to be exhaustive or to limit the invention to the precise form disclosed, and obviously many modifications and variations are possible in light of the above teaching. Such modifications and variations that may be apparent to a person skilled in the art are intended to be included within the scope of this invention as defined by the accompanying claims.

I claim:

1. A nail clipping apparatus comprising:

an upper movable body section and a lower stationary body section, said upper movable body section including a downwardly extending cutting edge and a pair of unitary, downwardly extending, opposing side members each movably disposed laterally beyond an opposing side of said lower stationary body section, said lower stationary body section including an upwardly extending cutting edge, said upper movable body section and said lower stationary body section forming an interior receptacle for capturing nail clippings severed by a coaction of said cutting edges, said upper movable body section further including an opening for accessing said interior receptacle and a cover for selectively sealing said opening;

lever means for displacing said upper movable body section toward said lower stationary body section, a displacement of said upper movable body section toward said lower stationary body section forcing said downwardly extending cutting edge toward said upwardly extending cutting edge to sever a portion of a user's nail inserted therebetween, said severed portion of said user's nail forming a nail clipping which is captured within said interior receptacle, a displacement of said upper movable body section toward said lower stationary body section further displacing the opposing side members of said upper movable body section over the opposing side of said lower stationary body section, said lever means further including a protuberance on an underside thereof for selectively engaging said upper movable body section as said lever means is displaced toward said upper movable body section;

means for pivotally securing said lever means to said lower stationary body section, said lever means being pivotable about a pivot axis; and means for pivotally securing said cover to said upper movable body section, wherein said cover is pivotable about an axis parallel to the pivot axis of said lever means between a first position in which said opening is uncovered and a second position in which said opening is sealed.

2. The nail clipping apparatus according to claim 1, wherein said lever means can be folded substantially flat against said upper movable body section only when said cover is in said first position.

3. The nail clipping apparatus according to claim 1, wherein, with said cover in said second position, the protuberance on the underside of said lever means engages an upper surface of said cover as said lever means is displaced toward said upper movable body section, thereby forcing the downwardly extending cutting edge of said upper movable body section toward the upwardly extending cutting edge of said lower stationary body section.

4. The nail clipping apparatus according to claim 1, wherein said means for pivotally securing said lever means includes a pair of upwardly extending flanges disposed adjacent the upwardly cutting edge of said lower stationary body section, each flange including means for rotatably receiving a portion of said lever means therein.

5. The nail clipping apparatus according to claim 4, wherein said receiving means is disposed above said upper movable body section.

* * * * *